US010863844B2

(12) United States Patent
Daniels

(10) Patent No.: US 10,863,844 B2
(45) Date of Patent: Dec. 15, 2020

(54) APPARATUS FOR DETERRING THEFT OF PACKAGES

(71) Applicant: Madison Daniels, Sherwood Park (CA)

(72) Inventor: Madison Daniels, Sherwood Park (CA)

( * ) Notice: Subject to any disclaimer, the term of this patent is extended or adjusted under 35 U.S.C. 154(b) by 0 days.

(21) Appl. No.: 16/365,999

(22) Filed: Mar. 27, 2019

(65) Prior Publication Data

US 2019/0298095 A1 Oct. 3, 2019

(30) Foreign Application Priority Data

Mar. 29, 2018 (CA) ..... 2999621
Jul. 9, 2018 (CA) ..... 3010833

(51) Int. Cl.
*A47G 29/20* (2006.01)
*A47G 29/124* (2006.01)
*E05B 67/38* (2006.01)

(52) U.S. Cl.
CPC ..... *A47G 29/20* (2013.01); *A47G 29/124* (2013.01); *E05B 67/383* (2013.01)

(58) Field of Classification Search
CPC ..... A47G 29/20; A47G 29/1203; A47G 29/1216; A47G 29/124; E05B 67/383; E05B 73/0005; E05B 73/00
USPC ..... 232/38, 39, 54, 63, 1 C
See application file for complete search history.

(56) References Cited

U.S. PATENT DOCUMENTS 403,790 A * 5/1889 Taylor ..... A47G 29/1201 232/24
461,208 A * 10/1891 Markell ..... A47G 29/1216 232/39
533,518 A * 2/1895 Witte ..... A47G 29/1216 232/54
555,948 A * 3/1896 Harrison et al. ... A47G 29/1209 232/49
626,251 A * 6/1899 Teevan et al. ..... A47G 29/1216 232/54
722,323 A * 3/1903 Parker ..... A47G 29/1216 232/54
752,600 A * 2/1904 Sinclair ..... A01K 97/06 43/54.1
1,228,057 A * 5/1917 Schaffer ..... A47G 29/20 232/41 R
4,098,454 A * 7/1978 Easter ..... A47G 29/1203 232/19
6,840,438 B2 * 1/2005 Hassan ..... A47G 29/1216 232/39
7,036,719 B1 * 5/2006 Helphrey ..... A47G 29/1209 232/30

(Continued)

*Primary Examiner* — William L Miller
(74) *Attorney, Agent, or Firm* — Davis & Bujold PLLC; Michael J. Bujold

(57) ABSTRACT

An apparatus for deterring theft of packages which includes an enclosure having an interior cavity. A conical inlet port provides access to the interior cavity. The conical inlet port has a wide end and a narrow end. The narrow end projects into the interior cavity. The narrow end normally has a first diameter. However, the narrow end expands to a second diameter in response to pressure from a package being pushed through the conical inlet port toward the interior cavity. The narrow end contracts back to the first diameter when pressure from the package is released, to prevent the package from being pulled by a thief back through the narrow end of the conical inlet port.

14 Claims, 10 Drawing Sheets

(56) References Cited

U.S. PATENT DOCUMENTS 8,261,965 B2 * 9/2012 Cyphers ..... A47G 29/124
232/45

* cited by examiner

APPARATUS FOR DETERRING THEFT OF PACKAGES

FIELD

There is described an apparatus that was developed for the purpose of deterring the theft of a package left at a residence by a delivery company.

BACKGROUND

There has been an explosion in online commerce in recent years. This has resulted in a corresponding increase in deliveries of packages containing consumer goods ordered online. When an addressee of a package is not home, it is the practise of many delivery companies to leave the package. Unfortunately, theft has become a problem. Gangs of thieves follow behind delivery trucks, picking up packages that are left outside of the residence.

SUMMARY

There is provided an apparatus for deterring theft of packages which includes an enclosure having an interior cavity. A conical inlet port provides access to the interior cavity. The conical inlet port has a wide end and a narrow end. The narrow end projects into the interior cavity. The narrow end normally has a first diameter. However, the narrow end expands to a second diameter in response to pressure from a package being pushed through the conical inlet port toward the interior cavity. The narrow end contracts back to the first diameter when pressure from the package is released, to prevent the package from being pulled by a thief back through the narrow end of the conical inlet port.

The preferred structure for the conical inlet port is a plurality of cantilever members, in one embodiment cantilever fins are illustrated. The fins are anchored to the wide end of the conical inlet port and are outwardly movable at the narrow end of the conical inlet port from the first diameter to the second diameter. They are, preferably, overlapping.

The enclosure can take a number of forms. However, when the enclosure is a container that could be taken by a thief, at least one anchor that anchors the container in a selected position, thereby providing a deterrent to theft of the container.

In order to keep cost down, it is preferred that the container take the form of a cut resistant and water resistant bag.

In order to simplify manufacture, it is preferred that the container have a package removal outlet, that is separate and distinct from the conical inlet port. Where the container is a cut resistant and water resistant bag, the preferred form of package removal outlet consists of two or more overlapping flaps. It is also preferred that one of the two or more overlapping flaps support an eyelet and the other of the two or more overlapping flaps have an opening through which the eyelet passes. This facilitates locking and anchoring of the cut resistant and water resistant bag. Where the container is a cut resistant and water resistant bag, it is also preferred that the container have an expanded operative position and a contracted stored position.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
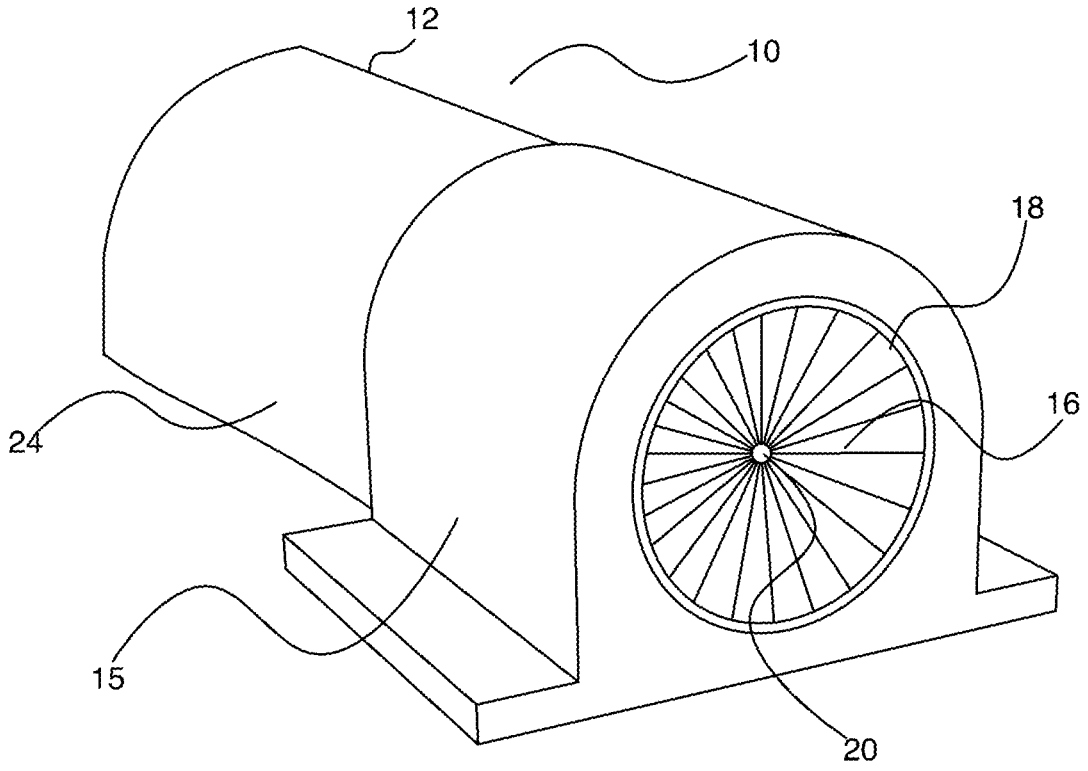
FIG. 1 is a front perspective view of a first embodiment of an apparatus for deterring theft of packages.

A first embodiment of apparatus for deterring theft of packages, generally identified by reference numeral 10, will be described with reference to FIG. 1 through FIG. 10. A second embodiment of apparatus for deterring theft of packages, generally identified by reference numeral 100, will be described with reference to FIG. 11 and FIG. 12. Subsequent modifications to apparatus 10, will be described with reference to FIG. 13 through FIG. 16.

Figure 2:
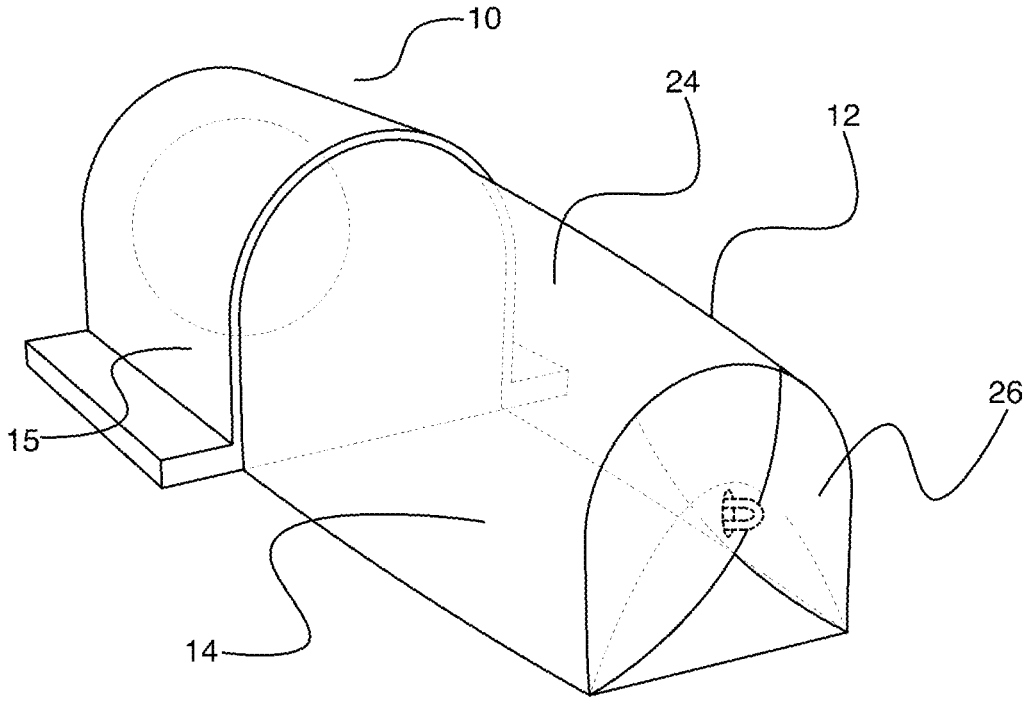
FIG. 2 is a rear perspective view of the apparatus for deterring theft of packages illustrated in FIG. 1.
Figure 3:
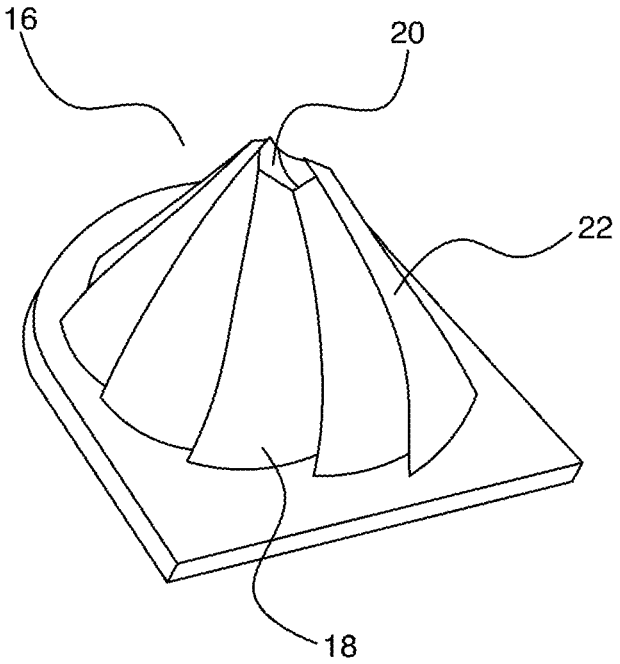
FIG. 3 is a detailed perspective view of a conical inlet port for the apparatus for deterring theft of packages illustrated in FIG. 1.
Figure 8:
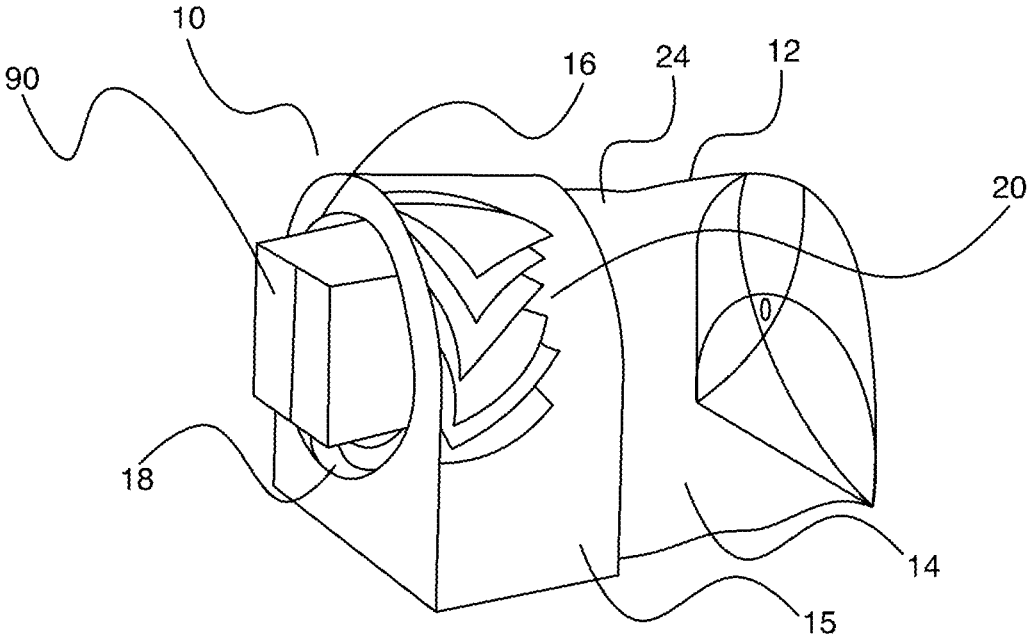
FIG. 8 is a side perspective view of the apparatus for deterring theft of packages illustrated in FIG. 1, with a package being inserted.
Figure 9:
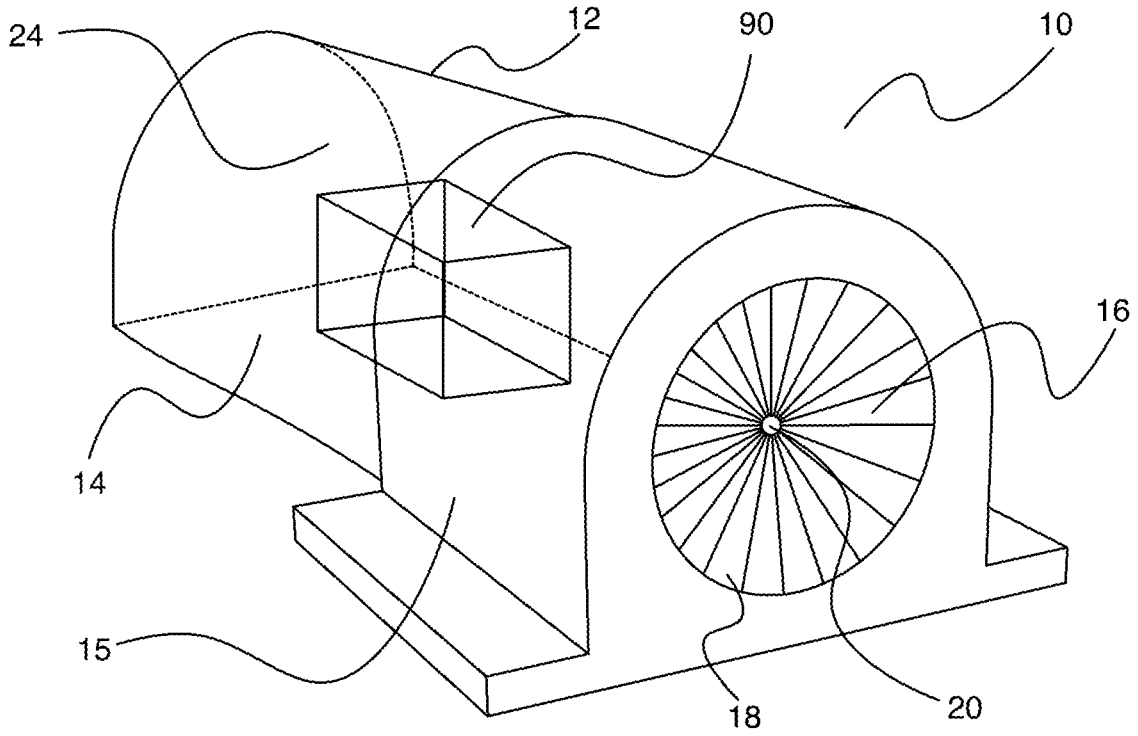
FIG. 9 is a front perspective view of the apparatus for deterring theft of packages illustrated in FIG. 1, with a package within the interior cavity.

Structure and Relationship of Parts:

Referring to FIG. 1 and FIG. 2, apparatus for deterring theft of packages 10 includes an enclosure 12 having an interior cavity 14. Referring to FIG. 1, attached to enclosure 12 is an entry housing 15 which supports a conical inlet port 16. Conical inlet port 16 provides access to interior cavity 14 of enclosure 12. Conical inlet port 16 has a wide end 18 and a narrow end 20. Narrow end 20 projects into interior cavity 14. Referring to FIG. 1 and FIG. 3, narrow end 20 normally has a first diameter. Referring to FIG. 8, narrow end 20 expands to a second diameter in response to pressure from a package 90 being pushed through conical inlet port 16 toward interior cavity 14. Referring to FIG. 9, narrow end 20 contracts back to the first diameter when pressure from package 90 is released, to prevent package 90 from being pulled by a thief back through narrow end 20 of conical inlet port 16.

Referring to FIG. 3, conical inlet port 16 has a plurality of cantilever members, in the form of fins 22. Fins 22 are anchored to wide end 18 of conical inlet port 16 and are outwardly movable at narrow end 20 of conical inlet port 16 from the first diameter to the second diameter, as illustrated in FIG. 8.

Figure 4:
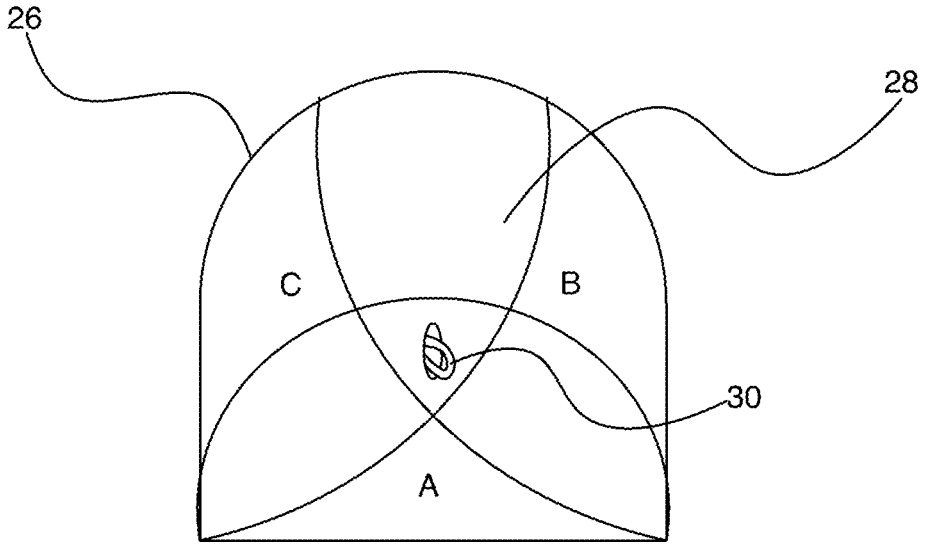
FIG. 4 is an end elevation view of a package removal outlet for the apparatus for deterring theft of packages illustrated in FIG. 2.

As will hereinafter be further explained under the heading "Variations" enclosure 12 can take a number of forms. Referring to FIG. 1 and FIG. 2, the preferred enclosure 12 is a container 24 made from a cut resistant and water resistant bag. Referring to FIG. 2, container 24 has a package removal outlet 26, that is separate and distinct from conical inlet port 16. Referring to FIG. 4, package removal outlet 26 consists of three overlapping flaps 28, labelled for identification as "A", "B" and "C". Flap 28A supports an eyelet 30. Flaps 28B and 28C have an opening 32 through which eyelet 30 passes. Referring to FIG. 6, an anchor cable 34 is passed through eyelet 30 for the purpose of locking and anchoring container 24 to an immovable object (a pole 36 has been selected for illustration). Container 24 has an expanded operative position and a contracted stored position. The expanded operative position is illustrated in FIG. 1, FIG. 2, FIG. 6, FIG. 8, FIG. 9 and FIG. 10. The contracted stored position is illustrated in FIG. 5, with an elastic cord 38 extended through eyelet 30 to maintain container 24 in the contracted stored position.

Figure 5:
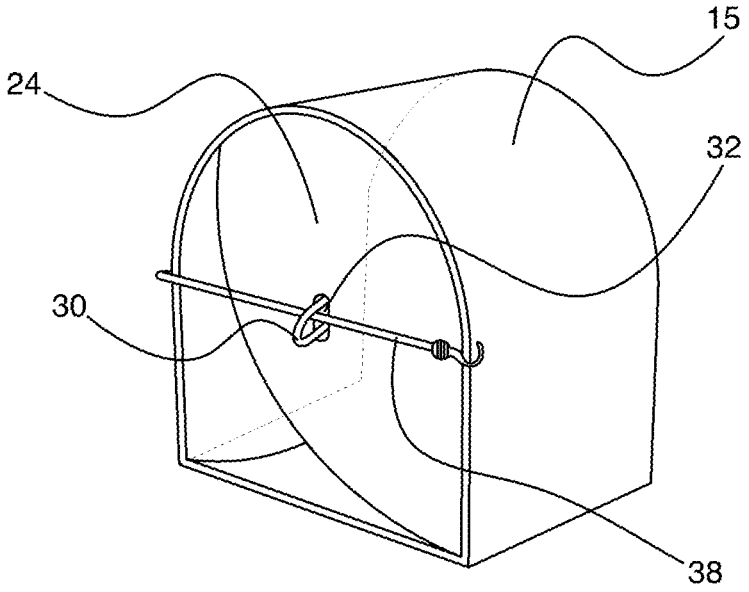
FIG. 5 is a rear perspective view of the apparatus for deterring theft of packages illustrated in FIG. 2, in a contracted stored position.
Figure 6:
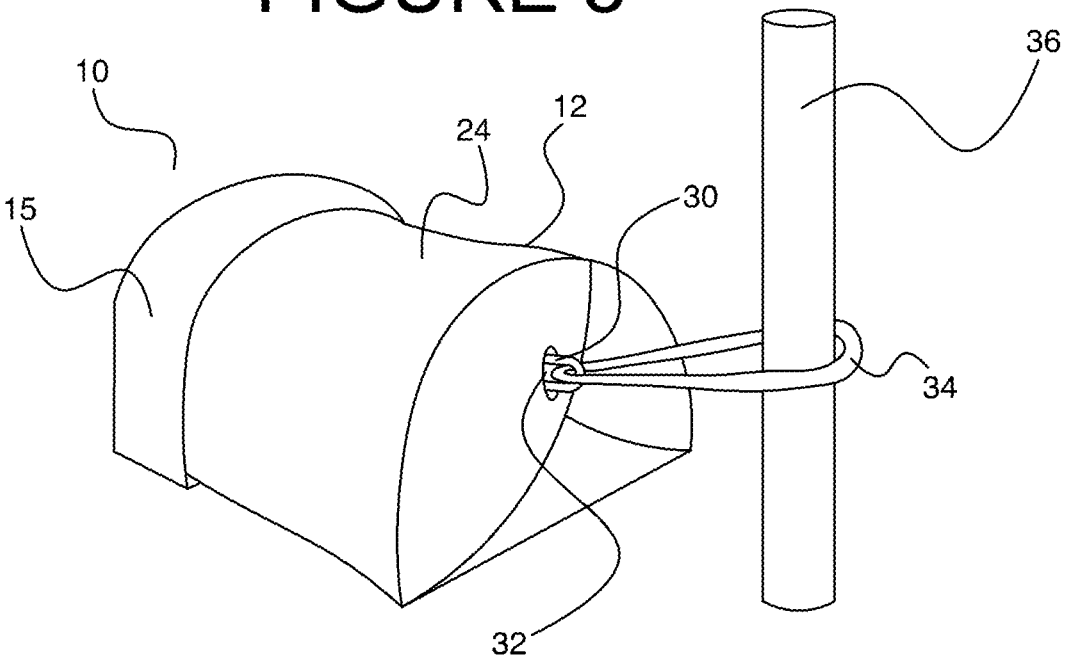
FIG. 6 is a rear perspective view of the apparatus for deterring theft of packages illustrated in FIG. 2, secured to an anchor.
Figure 7:
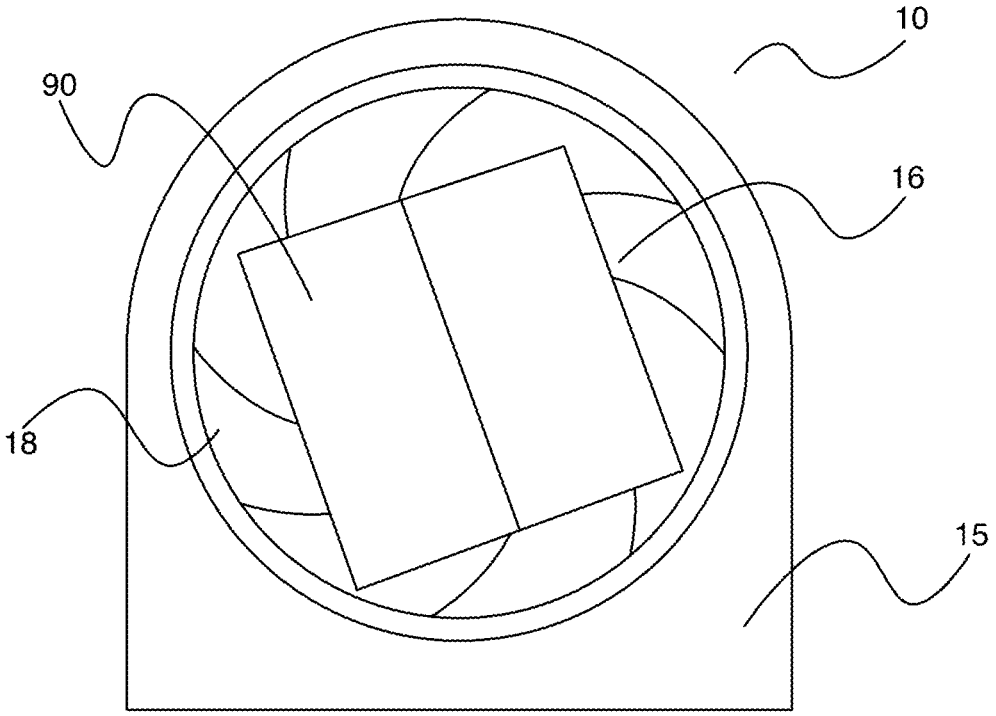
FIG. 7 is a front perspective view of the apparatus for deterring theft of packages illustrated in FIG. 1, with a package being inserted.
Figure 10:
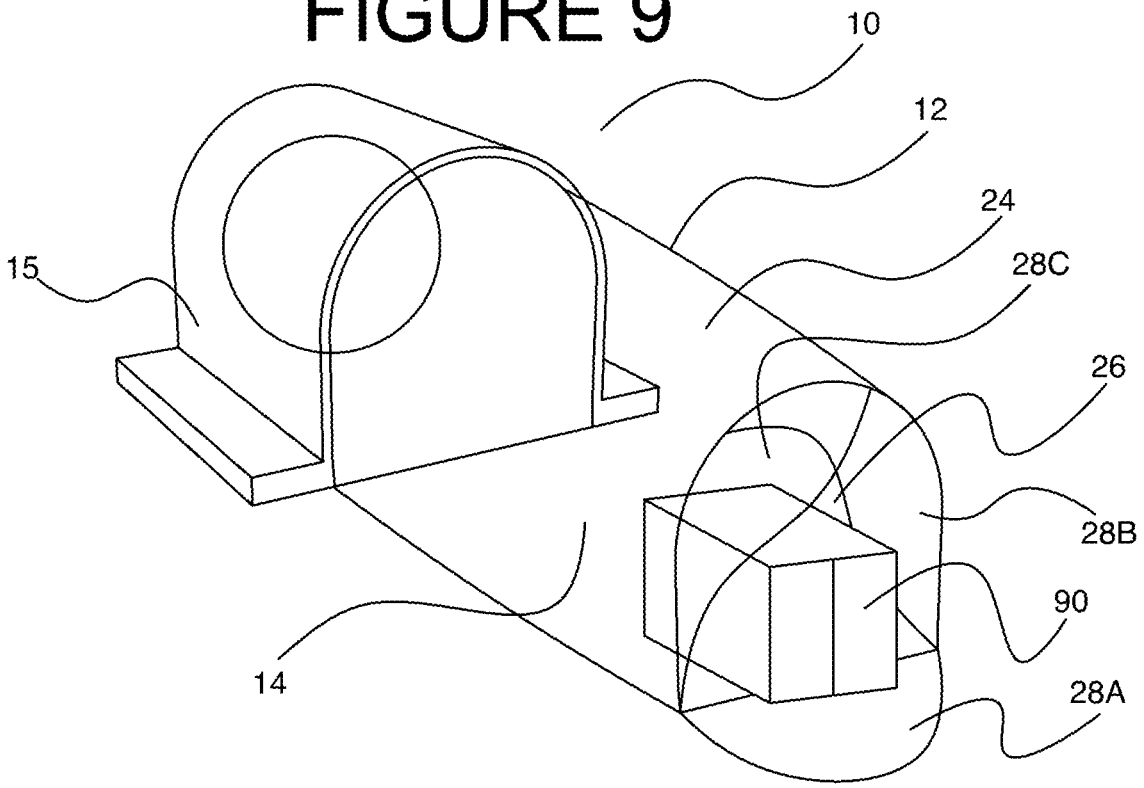
FIG. 10 is a rear perspective view of the apparatus for deterring theft of packages illustrated in FIG. 1, with a package being removed from the package removal outlet.

Operation:

Referring to FIG. 5, apparatus 10 is stored in the contracted stored position when not in use. Referring to FIG. 1 and FIG. 2, when a delivery is anticipated, apparatus 10 is placed in the expanded operative position. Referring to FIG. 6, anchor cable 34 is passed through opening 32 of eyelet 30 for the purpose of locking and anchoring container 24 to an immovable object, such as pole 36. Referring to FIG. 7, package 90 is inserted by the delivery person into wide end 18 of conical inlet port 16. Referring to FIG. 8, narrow end 20 expands to the second diameter in response to pressure from a package 90 being pushed through conical inlet port 16 toward interior cavity 14. Referring to FIG. 9, narrow end 20 contracts back to the first diameter when pressure from package 90 is released, to prevent package 90 from being pulled by a thief back through narrow end 20 of conical inlet port 16. Referring to FIG. 4, package removal outlet 26 has three overlapping flaps 28, labelled for identification as "A", "B" and "C". Referring to FIG. 10, once anchor cable 34 is removed from opening 32 of eyelet 30, flaps 28A, 28B and 28C can be separated to allow package 90 to be removed through package removal outlet 26.

Figure 11:
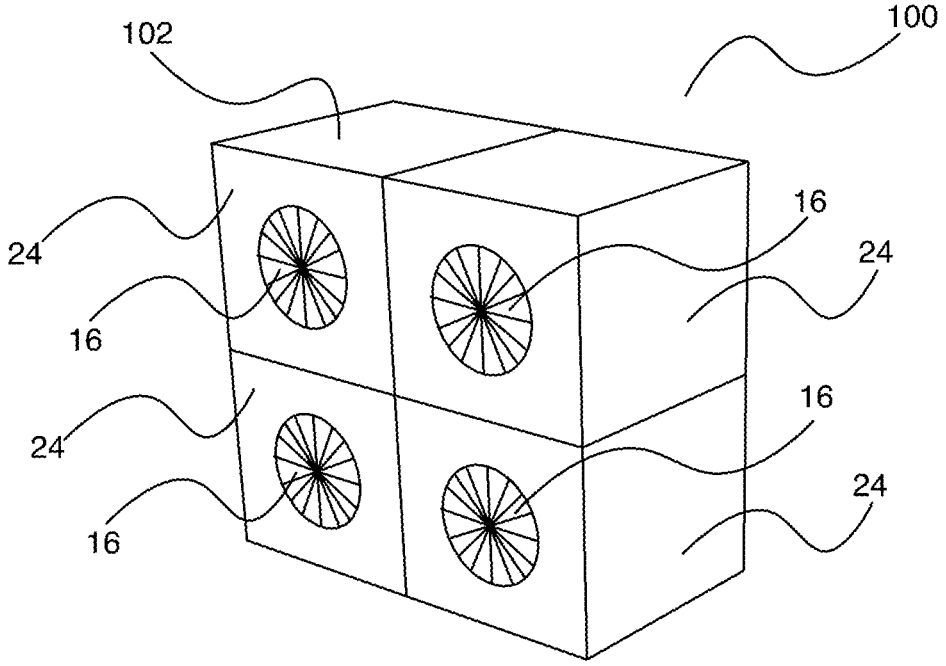
FIG. 11 is a front perspective view of a second embodiment of an apparatus for deterring theft of packages.
Figure 12:
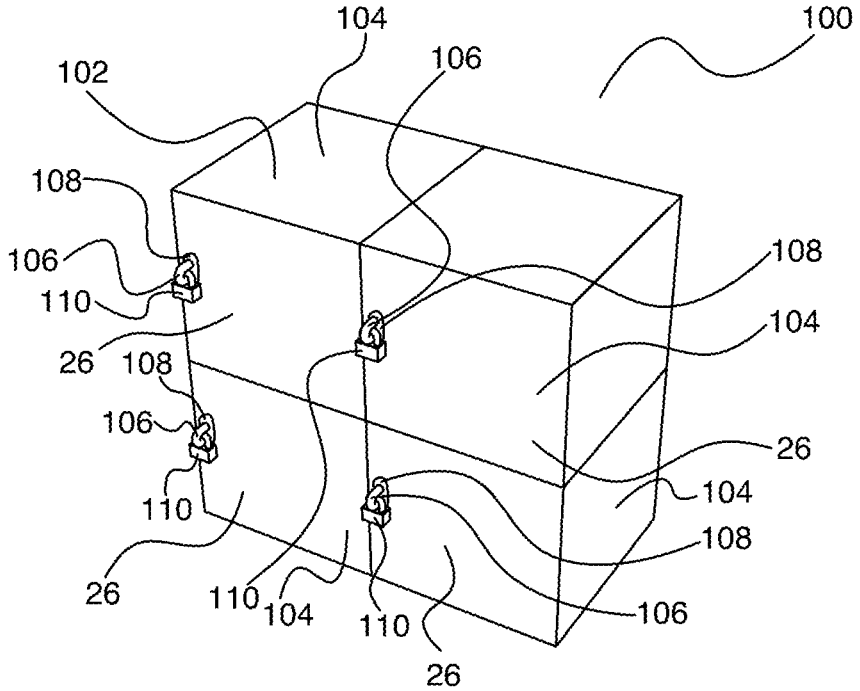
FIG. 12 is a rear perspective view of the apparatus for deterring theft of packages illustrated in FIG. 11.

Variations:

Referring to FIG. 11, apparatus 100 was developed for use in multi-unit buildings. A bank 102 of rigid containers 24 are provided (a bank of four container has been chosen for illustration). Each container 24 has a conical inlet port 16, which functions as described above. Referring to FIG. 12, each container has a package removal outlet 26. Each package removal outlet 26 has a single pivotally mounted door 104. An eyelet 106 anchored to container 24 extends through a slotted opening 108 in door 104. Door 104 is secured by placing a padlock 110 through eyelet 106.

Figure 13:
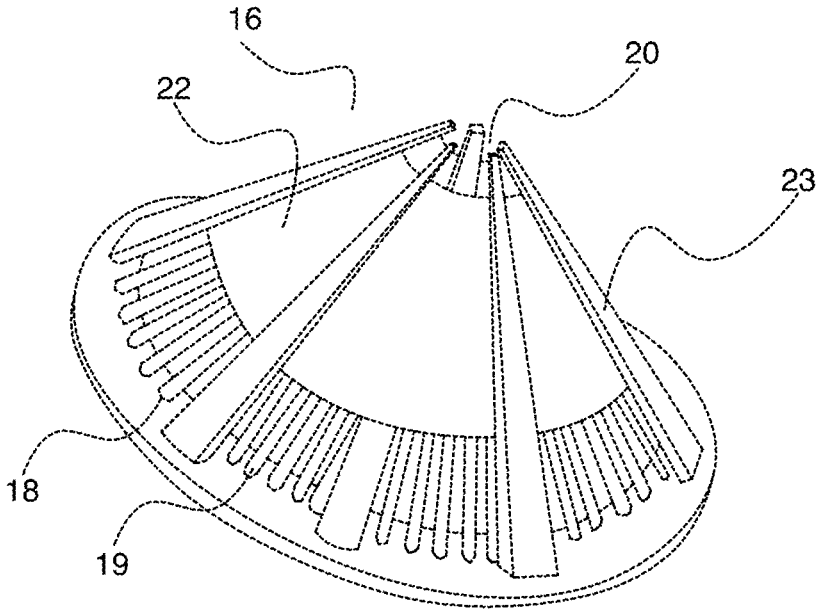
FIG. 13 is a perspective view, partially in section, of an alternative embodiment of conical inlet port.
Figure 15:
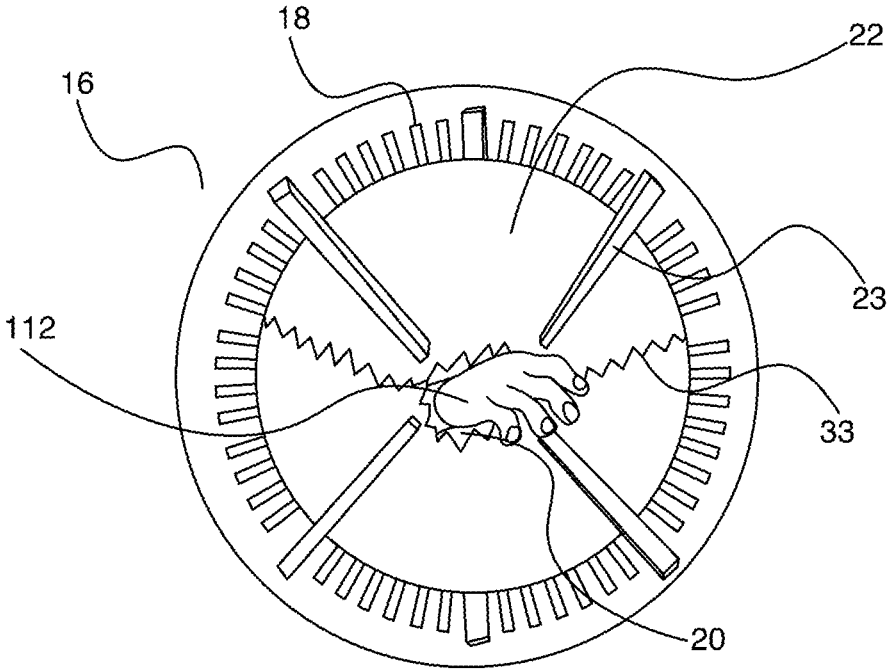
FIG. 15 is a rear perspective view of the conical inlet port of FIG. 13.
Figure 16:
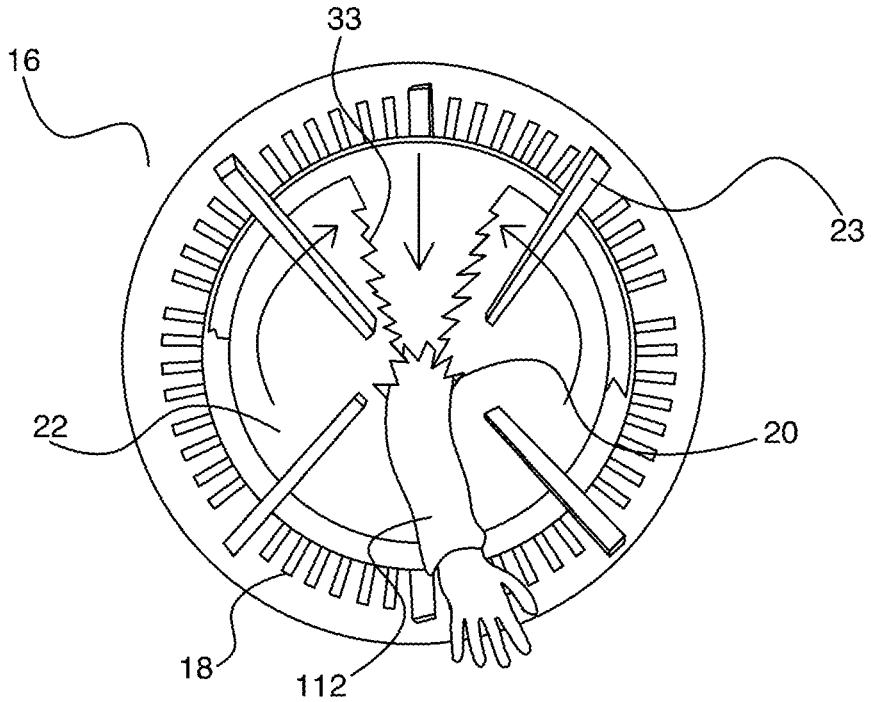
FIG. 16 is a rear perspective view of the conical inlet port of FIG. 13.

After testing proto-types of apparatus 10, there was a concern that small packages could be pulled back through conical inlet port 16. In order to address this concern, modifications were made to apparatus 10. Referring to FIG. 13, a first modification was placing reinforcing ribs 19 inside overlapping cantilever fins 22. The rationale behind this modification was to add strength to cantilever fins 22. A second modification was to add a row of cantilever supports 23 behind cantilever fins 22. The rationale behind this modification was to provide rear support for cantilever fins 22. The object of these modifications are to ensure that a thief cannot pass his arm between cantilever fins 22 or push them backwards. This leaves only narrow end 20 conical inlet port 16 through which an arm could be inserted. Referring to FIG. 15 and FIG. 16, a third modification was to add teeth 33 along the edges of cantilever fins 22. As a person inserts his or her arm 112 through conical inlet port 16, cantilever fins 22 flex allowing arm 112 entry. However, the farther arm 112 is inserted the more cantilever fins 22 "pinch" the person's arm 112. Teeth 33 on cantilever fins 22 dig into the person's arm 112 making it uncomfortable. When the person attempts to pull back arm 112 through narrow end 20 of conical inlet port 16, whether or not he or she is grasping a package, teeth aggressively dig into the person's arm making it difficult to pull arm 112 out of a conical inlet port 16, without releasing the package.

Figure 14:
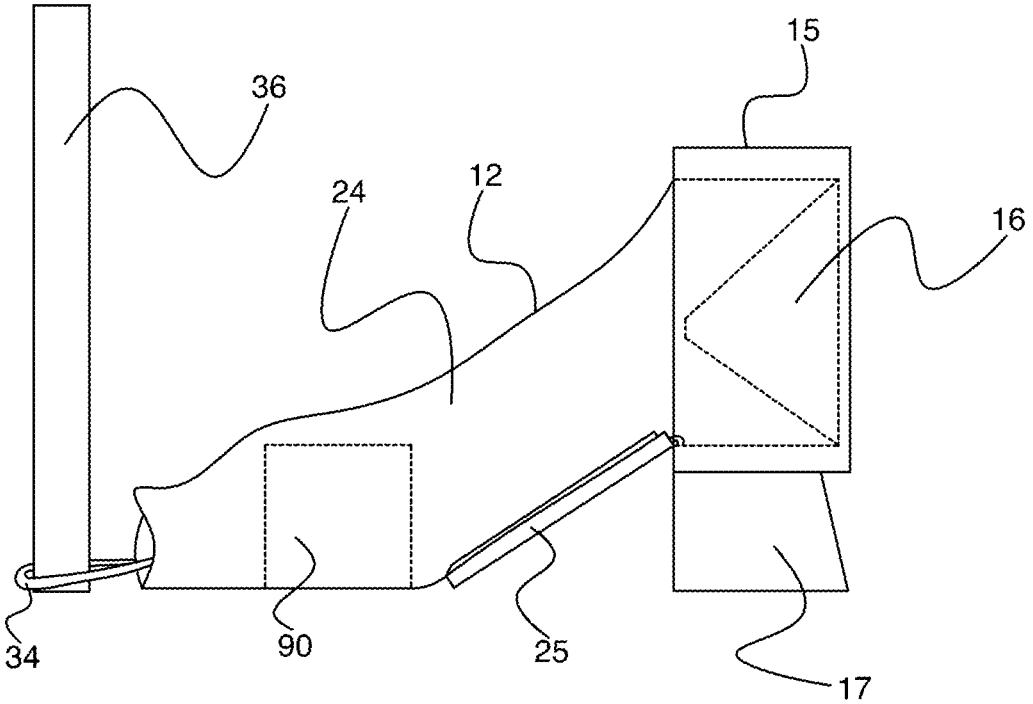
FIG. 14 is a side elevation view, in section, of an alternative embodiment of entry housing and enclosure.

Referring to FIG. 14, the second modification was to add legs 17 to entry housing 15, for the purpose of elevating entry housing 15 and to add a slide portion 25 to container 24 serving as enclosure 12 (As compared to FIG. 9). The rationale behind this modification was that, with entry housing 15 elevated, a small package 90 would slide down slide portion 25 away from conical inlet port 16 and would be difficult for a thief to reach. In order to reach, a thief must stabilize entry housing 15, with one hand while reaching at far as possible into conical inlet port 16.

It is believed that most package thefts are crimes of opportunity. If it is difficult and time consuming even try to manoeuver a package back through conical inlet port 16, it is believed that this will serve as a suitable deterrent to most thieves.

Figure 17:
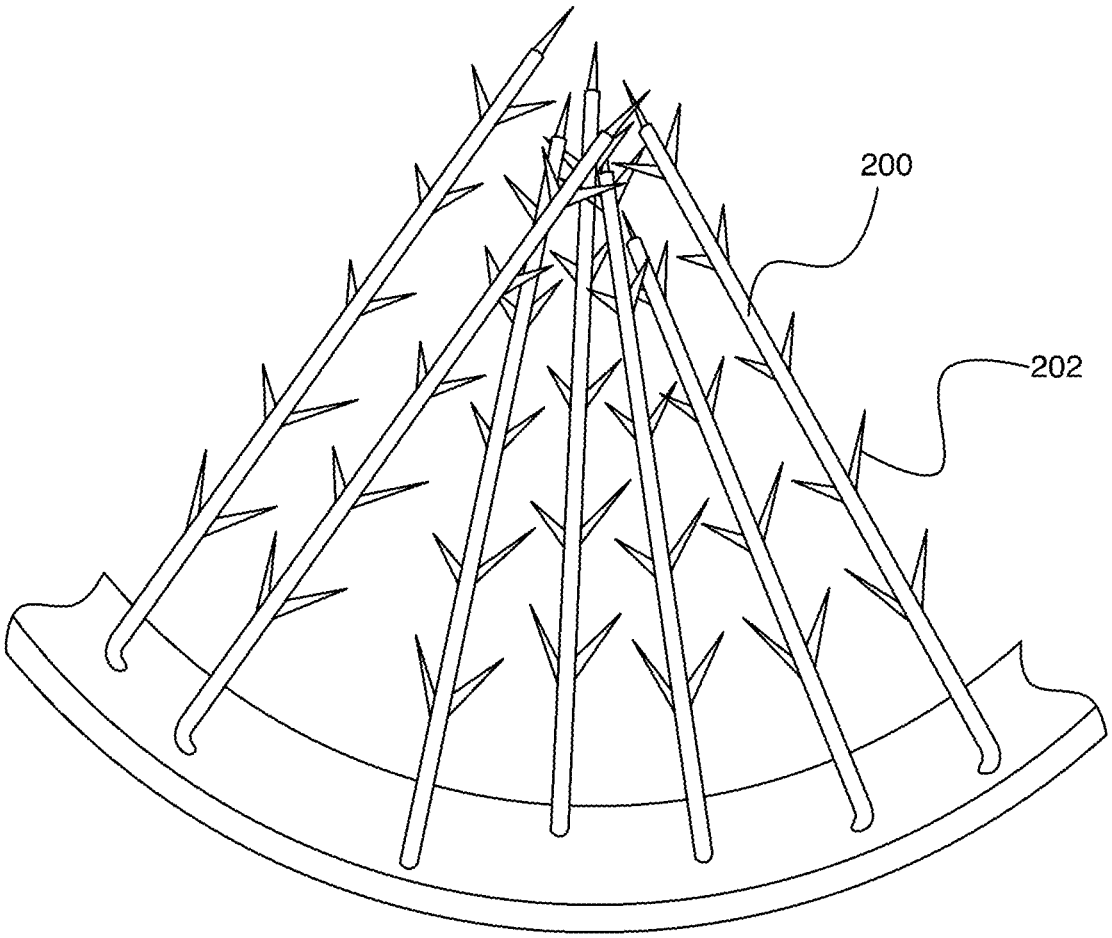
FIG. 17 is a detailed perspective view of an alternative embodiment in which cantilever members forming the conical inlet port each have a plurality of sharp pointed projections.
Figure 18:
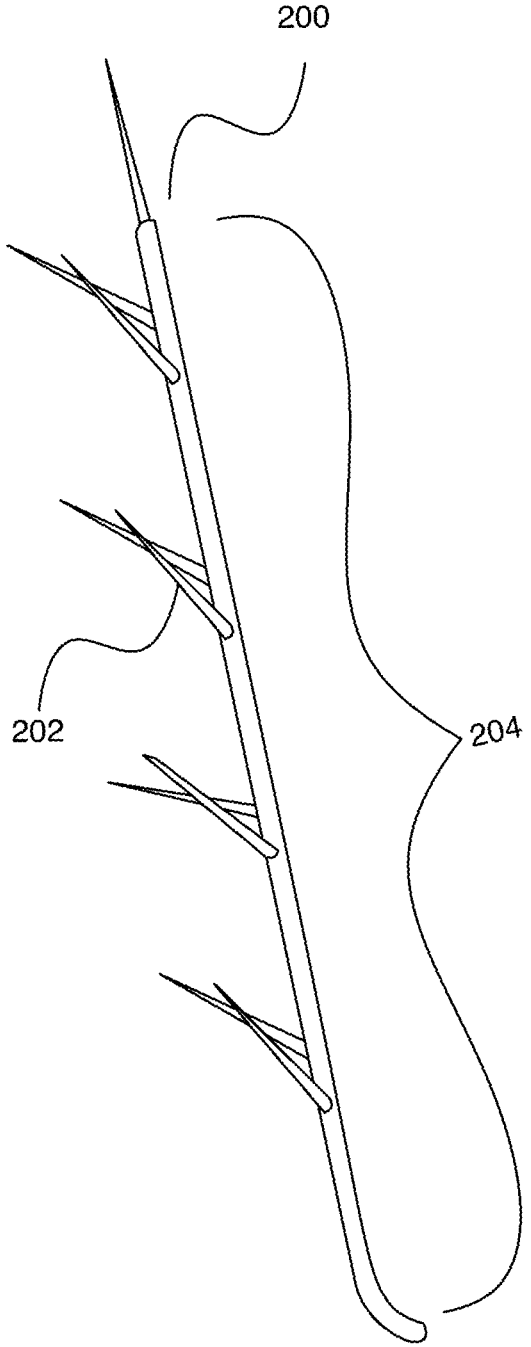
FIG. 18 is a side elevation view of the cantilever members of FIG. 17.
Figure 19:
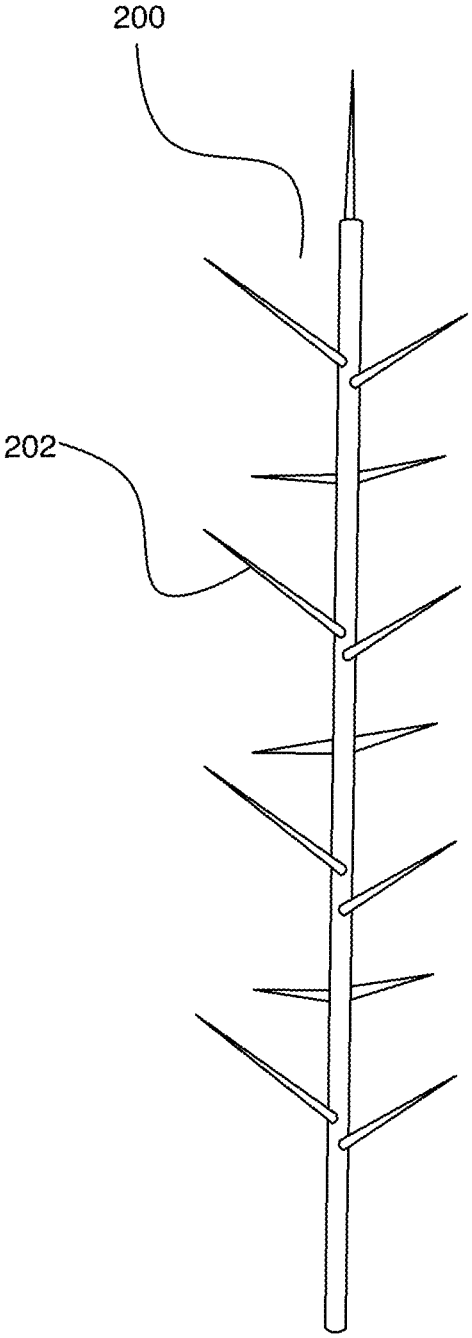
FIG. 19 is a bottom plan view of the cantilever members of FIG. 17.

In the embodiment illustrated in FIG. 3, the cantilever members were cantilever fins 22. In the embodiment illustrated in FIG. 15 and FIG. 16, teeth 33 were added along the edges of cantilever fins 22. Teeth 33 were intended to aggressively dig into a person's arm making theft both more difficult and uncomfortable. As consideration was given as how to reduce cost and make the apparatus for deterring theft of packages more secure, the embodiment illustrated in FIG. 17 through FIG. 19 was developed. In this embodiment, each of cantilever members 200 has a length with a plurality of sharp pointed projections 202 positioned in spaced relation along the length. Sharp pointed projections 202 are a substantial deterrent to thieves, as the sharp pointed projections 202 can cause serious injury. There was concern that the sharp pointed projections 202 could cause damages to the packages that the apparatus for deterring packaging was intended to protect. Referring to FIG. 18, this concern was addressed by creating a lengthwise zone 204 on a perimeter of cantilever members 200 which is devoid of sharp pointed projections 202, in contrast to the balance of cantilever members 200, as shown in FIG. 19. In use, cantilever members are oriented so that, when the packages are pushed through the opening, as illustrated in FIG. 7 and FIG. 8, the packages are pressing against the lengthwise zone 204 on the perimeter of cantilever members 200 is devoid of sharp pointed projections 202. However, when a thief tries to reach between cantilever members 200 and pull a package in any other direction the thief is unavoidably exposed to a number of sharp pointed projections 202.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. An apparatus for deterring theft of packages, comprising:

a secure enclosure having an interior cavity and a conical inlet port that provides access to the interior cavity, the conical inlet port having a wide end and a narrow end, the narrow end projecting into the interior cavity, the narrow end normally having a first diameter, the narrow end expanding to a second diameter in response to pressure from a package being pushed through the conical inlet port toward the interior cavity, the narrow end then contracting to the first diameter when pressure from the package is released to prevent the package from being pulled back through the narrow end of the conical inlet port;

wherein the conical inlet port is comprised of a plurality of cantilever members which are anchored to the wide end of the conical inlet port and are outwardly movable at the narrow end of the conical inlet port from the first diameter to the second diameter; and wherein each of the cantilever members has a length with a plurality of sharp pointed projections positioned in spaced relation along the length.

2. The apparatus of claim 1, wherein the secure enclosure is a container.

3. The apparatus of claim 2, wherein there is at least one anchor that anchors the container in a selected position, thereby providing a deterrent to theft of the container.

4. The apparatus of claim 2, wherein the container has a package removal outlet, that is separate and distinct from the conical inlet port.

5. The apparatus of claim 4, wherein the container is a cut resistant and water resistant bag.

6. The apparatus of claim 5, wherein the container has an expanded operative position and a contracted stored position.

7. The apparatus of claim 4, wherein the package removal outlet is comprised of two or more overlapping flaps.

8. The apparatus of claim 7, wherein one of the two or more overlapping flaps supports an eyelet and the other of the two or more overlapping flaps has an opening through which the eyelet passes.

9. The apparatus of claim 1, wherein the conical inlet port is supported by an entry housing which is attached to the enclosure.

10. The apparatus of claim 9, wherein the entry housing has legs which elevate the entry housing and the enclosure has a slide portion, such that packages passing through the conical inlet port slide down the slide portion of the enclosure away from the entry housing.

11. The apparatus of claim 1, wherein each of the cantilever members has a perimeter with a lengthwise zone on the perimeter devoid of the sharp pointed projections.

12. An apparatus for deterring theft of packages, comprising:

an enclosure having an interior cavity and a conical inlet port that provides access to the interior cavity, the conical inlet port having a wide end and a narrow end, the narrow end projecting into the interior cavity, the narrow end normally having a first diameter, the narrow end expanding to a second diameter in response to pressure from a package being pushed through the conical inlet port toward the interior cavity, the narrow end then contracting to the first diameter when pressure from the package is released to prevent the package from being pulled back through the narrow end of the conical inlet port;

wherein the conical inlet port is comprised of a plurality of cantilever members which are anchored to the wide end of the conical inlet port and are outwardly movable at the narrow end of the conical inlet port from the first diameter to the second diameter; and wherein the cantilever members are made from fabric and have reinforcing ribs.

13. The apparatus of claim 10, wherein a row of cantilever supports is positioned behind the cantilever members.

14. An apparatus for deterring theft of packages, comprising:

an enclosure having an interior cavity and a conical inlet port that provides access to the interior cavity, the conical inlet port having a wide end and a narrow end, the narrow end projecting into the interior cavity, the narrow end normally having a first diameter, the narrow end expanding to a second diameter in response to pressure from a package being pushed through the conical inlet port toward the interior cavity, the narrow end then contracting to the first diameter when pressure from the package is released to prevent the package from being pulled back through the narrow end of the conical inlet port;

wherein the conical inlet port is comprised of a plurality of cantilever members which are anchored to the wide end of the conical inlet port and are outwardly movable at the narrow end of the conical inlet port from the first diameter to the second diameter; and wherein the cantilever members are overlapping fins.

* * * * *